US008118034B2

(12) United States Patent
Faraci et al.

(10) Patent No.: US 8,118,034 B2
(45) Date of Patent: Feb. 21, 2012

(54) BRAND CONTROL METHOD FOR AN AUTOMATIC TOBACCO ARTICLE PROCESSING MACHINE

(75) Inventors: Giuseppe Faraci, Ferrara (IT); Carlo Moretti, Bologna (IT); Gaetano De Pietra, Casalecchio Di Reno (IT)

(73) Assignee: G. D Societa' per Azioni, Bologna (IT)

( * ) Notice: Subject to any disclaimer, the term of this patent is extended or adjusted under 35 U.S.C. 154(b) by 520 days.

(21) Appl. No.: 12/401,636

(22) Filed: Mar. 11, 2009

(65) Prior Publication Data

US 2009/0293890 A1 Dec. 3, 2009

(30) Foreign Application Priority Data

Mar. 11, 2008 (IT) ..... BO2008A0158

(51) Int. Cl.
*A24C 5/32* (2006.01)
*G06F 19/00* (2011.01)

(52) U.S. Cl. ..... 131/280; 700/117; 700/97

(58) Field of Classification Search ..... 131/280; 700/97, 117

See application file for complete search history.

(56) References Cited

U.S. PATENT DOCUMENTS 5,537,798 A 7/1996 Fukuda et al.
7,117,872 B2 * 10/2006 Draghetti et al. ..... 131/280

FOREIGN PATENT DOCUMENTS

DE 102006017106 A1 10/2007
EP 1225491 A1 1/2002
EP 2075660 A1 12/2007
WO 03/074361 A1 9/2003

OTHER PUBLICATIONS

Search Report of European Application No. 09154814.9 Dated May 25, 2011.

* cited by examiner

*Primary Examiner* — Richard Crispino
*Assistant Examiner* — Dionne Walls Mayes
(74) *Attorney, Agent, or Firm* — Ladas & Parry LLP

(57) ABSTRACT

A brand control method for an automatic tobacco article processing machine, the method including the steps of: defining a number of end product brands that can be produced on the automatic machine; creating a number of configurations, each associated with a respective brand and having a set of values of control parameters controlling electrically controlled operating parts to produce the brand; selecting a desired end product brand; loading the configuration corresponding to the desired end product brand onto a control unit to commence production of the desired brand; defining a number of sections, each having a set of control parameters and independent of the other sections; defining a number of recipes by assigning each section at least one respective set of values of the corresponding control parameters, so each recipe corresponds to a respective section and contains the values of the control parameters in that particular section; and defining each configuration by combining a number of compatible recipes, so that each recipe may potentially form part of a number of different configurations.

13 Claims, 5 Drawing Sheets

BRAND CONTROL METHOD FOR AN AUTOMATIC TOBACCO ARTICLE PROCESSING MACHINE

TECHNICAL FIELD

The present invention relates to a brand control method for an automatic tobacco article processing machine.

The present invention may be used to advantage on an automatic packing machine for producing packets of cigarettes, to which the following description refers purely by way of example.

BACKGROUND ART

At one time, a cigarette packing line produced packets of cigarettes of one brand with no changes over a prolonged period of time. More recently, attempts have been made to adopt a so-called "just in time" practice, whereby the brand produced on a given cigarette packing line is changed frequently to real-time adapt to market demand and so reduce storage. As a result, automatic packing machines producing packets of cigarettes now undergo increasingly frequent brand changes.

Brand changing on an automatic packing machine producing packets of cigarettes normally comprises two types of intervention: "mechanical" or "hardware" changes, which consist in physically adjusting the component parts of the packing machine and/or changing component parts incompatible with the new brand; and "logic" or "software" changes, which consist in replacing the old-brand configuration with that of the new brand in the control unit of the packing machine. Brand configurations are the values of the parameters controlling the electrically controlled operating parts of the packing machine to produce the brand. In other words, the packing machine comprises various electric/electronic operating parts (i.e. electrically controlled parts, such as servovalves, electric actuators, sensors, heating resistors), each controlled by a control algorithm implemented by the control unit and which employs control parameters whose values may vary depending on the brand for production (e.g. the sealing temperature of a heating resistor may vary depending on the packing material used, or the movement of an electric actuator may vary depending on the size of the packet of cigarettes for packing, or the characteristics of the packing materials). To produce a given brand, the control unit must therefore be given the corresponding configuration, i.e. the corresponding values of the parameters controlling the electrically controlled operating parts of the packing machine.

On currently marketed automatic packing machines, all the producible brand configurations are memorized in a bulk storage memory of the control unit, in which each configuration is memorized and controlled as a single, indivisible database containing all the parameter values controlling the electrically controlled operating parts. And the most common way of creating a new configuration, for example, is to duplicate (i.e. "copy & paste") the existing configuration most closely resembling the new one, and then alter certain parts of the duplicate.

The above configuration control method has the advantage of being extremely straightforward and intuitive, but is not very efficient, on account of the configurations being completely unrelated and independent, regardless of the resemblance between them. That is, if two only slightly different configurations, e.g. 3 out of 500 values, are required, two separate, almost identical databases must still be created in the control unit bulk storage memory. And if either of the configurations is updated slightly at a later date to improve the production process (as frequently occurs in the case of packing processes), it is desirable that the same updates also be copied in the other configuration. Otherwise, the benefits of the improvement are not extended to all the configurations, and, more importantly, the configurations operate differently, thus seriously complicating maintenance, adjustment, and production process improvement. At each configuration update, the operator should therefore determine whether the same also applies to the other configurations. But since this is a long, painstaking job (especially when numerous configurations are involved) and potentially subject to error, very often it is not done.

DISCLOSURE OF THE INVENTION

It is an object of the present invention to provide a brand control method for an automatic tobacco article processing machine, that is cheap and easy to implement and provides for eliminating the aforementioned drawbacks.

According to the present invention, there is provided a brand control method for an automatic tobacco article processing machine, as claimed in the attached Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
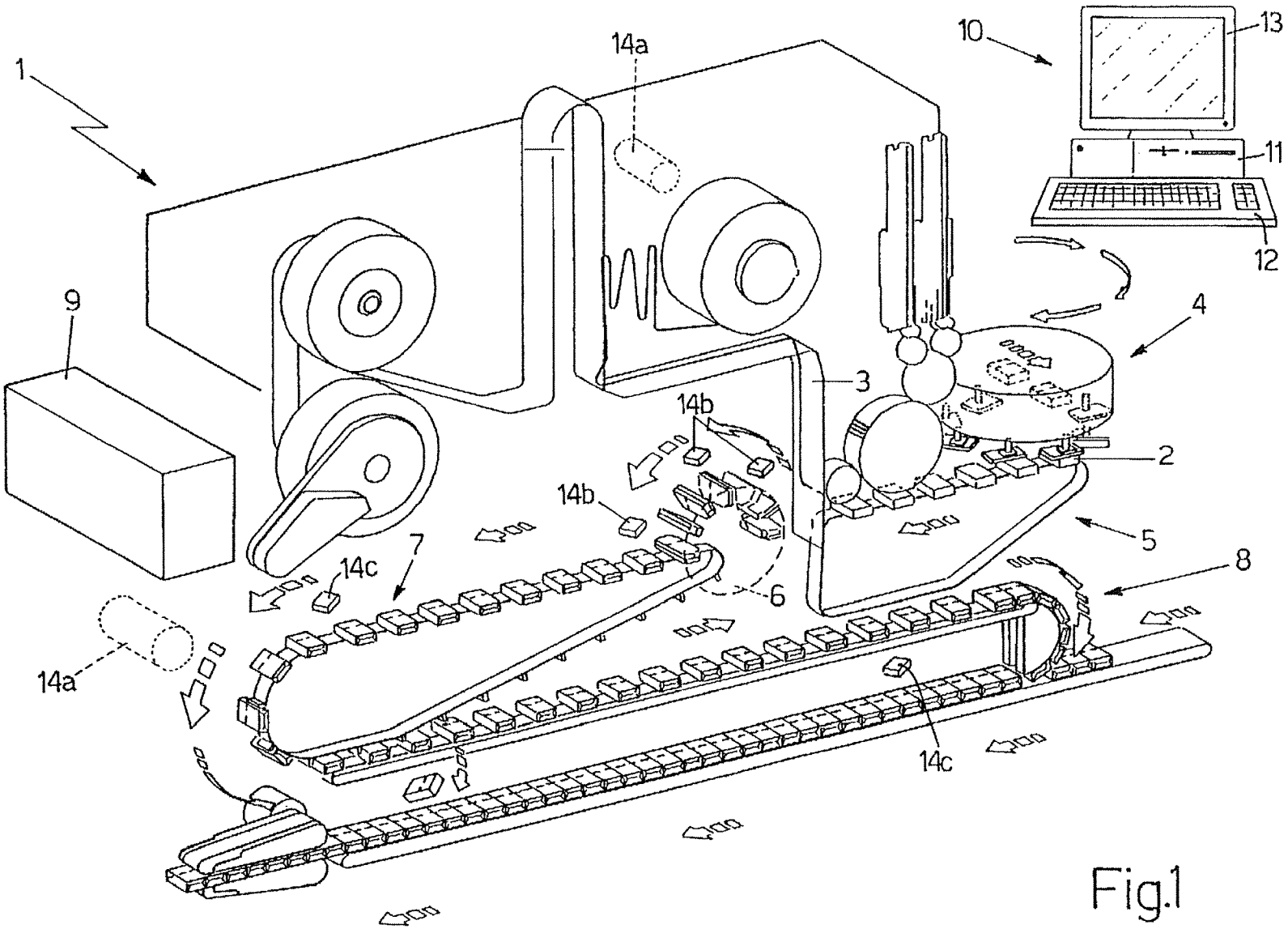
FIG. 1 shows a schematic front view of an automatic packing machine for overwrapping packets of cigarettes and implementing the brand control method according to the present invention.

Number 1 in FIG. 1 indicates as a whole a known automatic packing machine (in particular, a G.D. model C800 cellophaning machine) for overwrapping packets 2 of cigarettes in respective sheets 3 of transparent plastic wrapping. In other words, automatic machine 1 comprises a production line, along which a number of materials (i.e. packets 2 of cigarettes and sheets 3 of wrapping, normally with respective tear tapes not shown in detail) are fed and processed to produce an end product, i.e. overwrapped packets 2 of cigarettes.

Automatic machine 1 comprises an input spider 4, which transfers packets 2 to a belt conveyor 5, which feeds packets 2, together with respective sheets 3, to a packing wheel 6, on which tubular wrappings are formed from sheets 3 about respective packets 2 and stabilized laterally. The tubular wrappings are transferred from wheel 6 to a belt conveyor 7, along the path of which, sheets 3 are finish-folded about respective packets 2 and stabilized by heat sealing the ends. Packets 2, overwrapped in respective sheets 3, are transferred from belt conveyor 7 to a conveyor 8 and fed to an automatic cartoning machine (not shown in FIG. 1).

Automatic machine 1 comprises a control unit 9 for supervising operation of automatic machine 1, and which is connected to an interface (so-called HMI) device 10 enabling the operator to interact with control unit 9. Interface device 10 comprises an industrial personal computer 11; an input device 12 (typically a keyboard and/or pointing device) by which the operator enters commands on control unit 9; and a screen 13, on which information is displayed by control unit 9. In a preferred embodiment, screen 13 also features a "touch-screen" device to simplify command entry by the operator, as an alternative to input device 12.

Machine 1 comprises a number of known electric/electronic operating parts 14 (shown schematically) distributed along the production line and for performing respective functions when activated by control unit 9. For example, electric/electronic operating parts 14 comprise electric motors 14*a*, solenoid valves 14*b*, sensors 14*c* (shown schematically in FIG. 1 purely by way of example), and heating resistors. In a preferred embodiment, electric/electronic operating parts 14 are connected to one another, and are connected to control unit 9 over a FieldBus control network, whereas interface device 10 and control unit 9 are connected over a computer, e.g. Ethernet, network.

Each electric/electronic (i.e. electrically controlled) operating part 14 is controlled by a respective control algorithm implemented in control unit 9, and which uses control parameters 15 (shown schematically in FIG. 2) whose values 16 (shown schematically in FIG. 3) may vary depending on the brand being produced (e.g. the sealing temperature of a heating resistor may vary depending on the packing material used, or the movement of an electric actuator may vary depending on the size of packets 2 of cigarettes for packing, or the characteristics of the packing material). It is important to note that values 16 in general may be alphanumeric, e.g. may be numeric or logic (e.g. YES/NO) values.

Machine 1 is potentially capable of producing numerous brands of packets 2 of cigarettes, and, to produce a given brand, must be adapted accordingly by means of a brand change. In other words, a brand change serves to adapt machine 1 to the manufacture of a given brand of packet 2 of cigarettes, and, on machine 1, comprises two types of intervention: "mechanical" or "hardware" changes, which consist in physically adjusting the component parts of machine 1 and/or changing component parts incompatible with the new brand; and "logic" or "software" changes, which consist in replacing the old-brand configuration 17 with the new-brand configuration 17 in the automatic packing machine control unit. A brand configuration 17 is composed of a set of values 16 of the parameters 15 controlling electrically controlled operating parts 14 to produce the brand. In other words, for packing machine 1 to produce a given brand, control unit 9 must be given the corresponding configuration 17, i.e. the corresponding set of values 16 of parameters 15 controlling electrically controlled operating parts 14.

To begin with, a number of brands of packets 2 of cigarettes (i.e. of the end product) producible on automatic machine 1 are determined; and a number of configurations 17 are then created, each associated with a respective brand of packet 2 of cigarettes, and, as stated, each comprising a set of values 16 of parameters 15 controlling electrically controlled operating parts 14 to produce the brand. Configurations 17 are typically memorized in a bulk storage memory of control unit 9 or a bulk storage memory of interface device 10 for fast retrieval, so that, when a given brand of packet 2 of cigarettes (i.e. end product) is selected in control unit 9 (in particular, in a RAM memory of control unit 9), the configuration 17 corresponding to the selected brand of packet 2 of cigarettes (i.e. end product) is loaded to start production of the selected brand.

Figure 2:
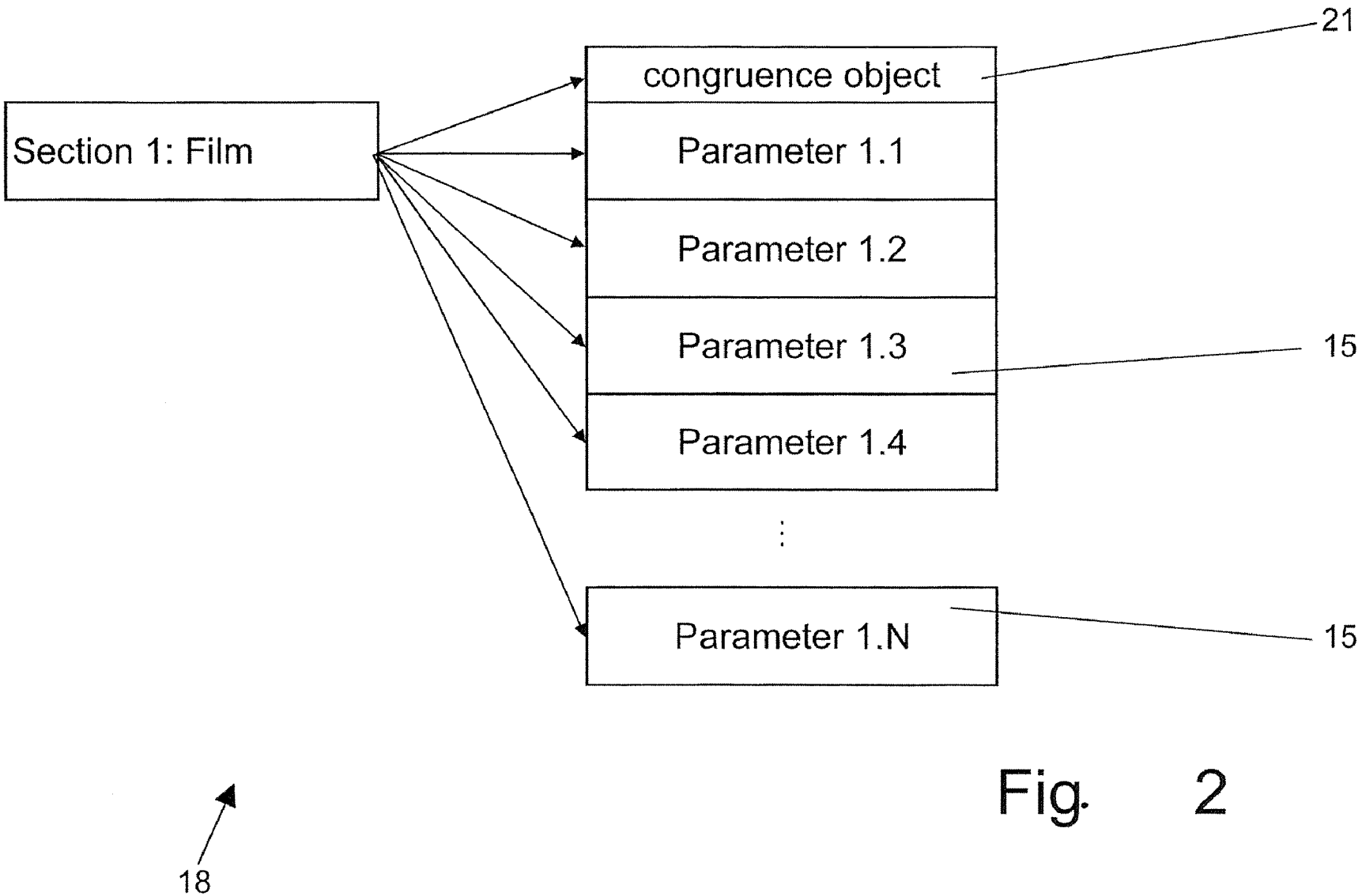
FIGS. 2-5 show four example tables of the way in which brand data is organized.
Figure 3:
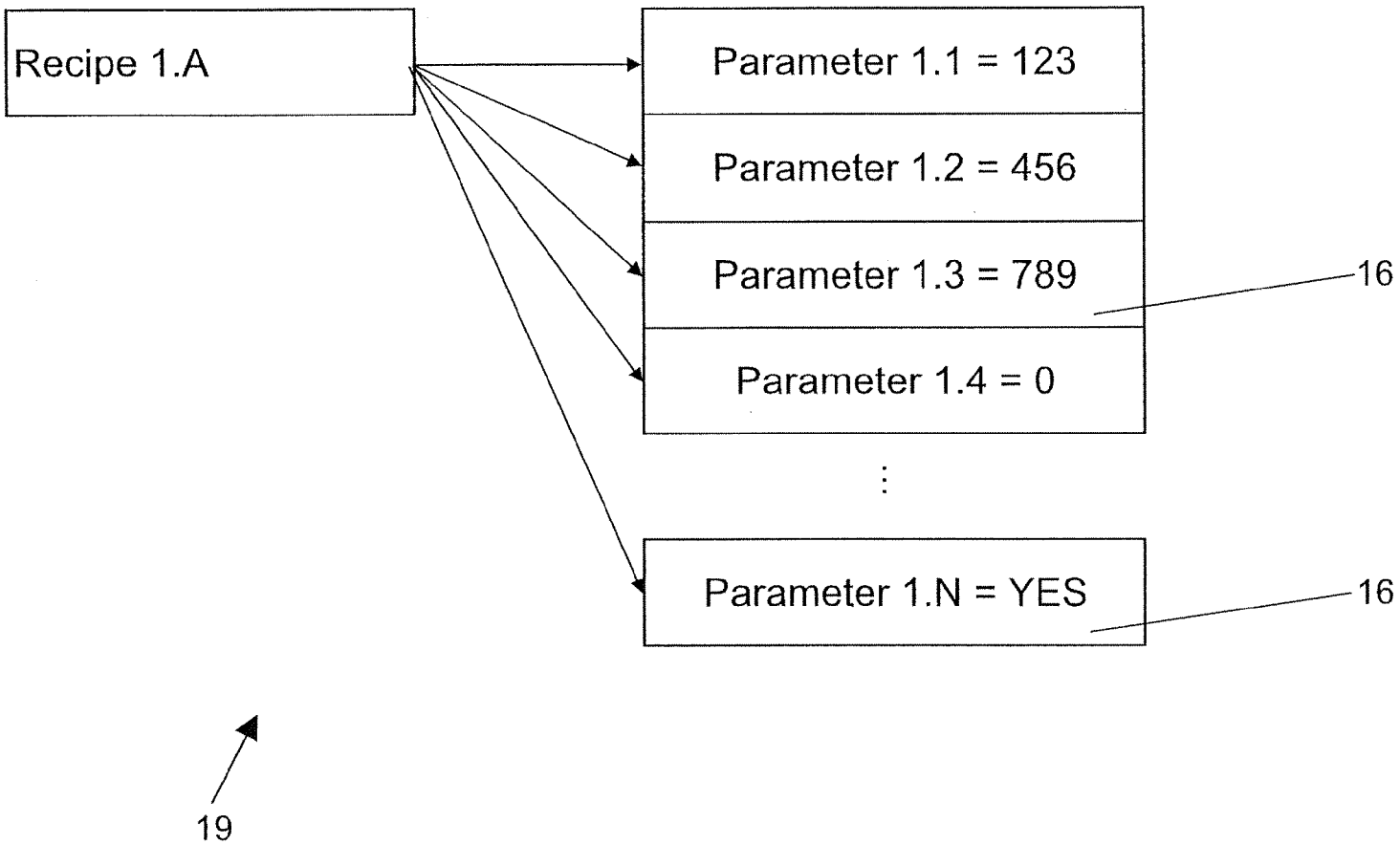
Figure 4:
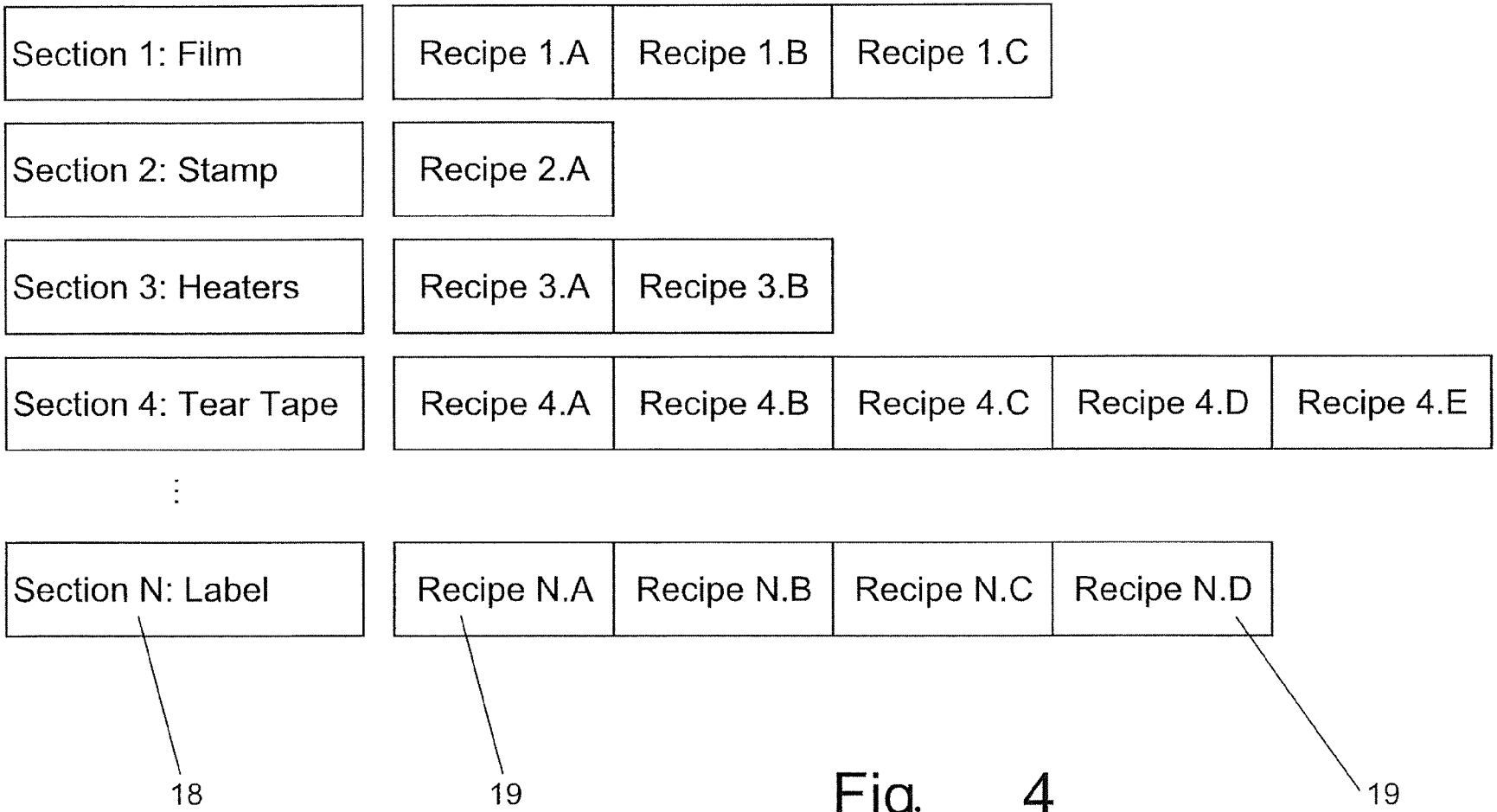

As shown in FIG. 4, a number of sections 18 (indicated 1, 2, 3, 4 . . . N in FIG. 4 by way of example) are defined, each comprising a set of control parameters 15, and each independent of the other sections 18. Control parameters 15 in the same section 18 are preferably related. More specifically, control parameters 15 in the same section 18 relate to operating parts 14 in the same section 18 of machine 1 (spatial relationship) or to operating parts 14 performing the same function (functional relationship). For example, section 18 indicated "Film" may comprise all the parameters 15 controlling supply of sheets 3 of wrapping cut off a continuous reel-fed web; and section 18 indicated "Heaters" may comprise all the parameters 15 controlling the heat sealing devices for heat sealing the folded sheets 3 of wrapping. By way of example, FIG. 2 shows, schematically, the "Film" section 18, which comprises N parameters 15 controlling supply of sheets 3 of wrapping.

As shown in FIG. 4, once sections 18 are defined (at the design stage of machine 1), a number of recipes 19 (tagged 1.A, 1.B, 1.C . . . ) are determined by assigning each section 18 at least one set of values 16 of corresponding control parameters 15, so that each recipe 19 corresponds to a respective section 18 and contains the values 16 of control parameters 15 in the same section 18. In other words, and as shown more clearly in FIG. 3, at least one recipe 19, comprising the set of values 16 of control parameters 15 in the same section 18, is created for each section 18.

It is important to note that sections 18 are defined at the design stage of machine 1 and are not normally changed (unless structural changes are made to machine 1), whereas recipes 19 may be continually added, deleted or modified, depending on the production demands of machine 1 and improvements to operation of machine 1.

Figure 5:
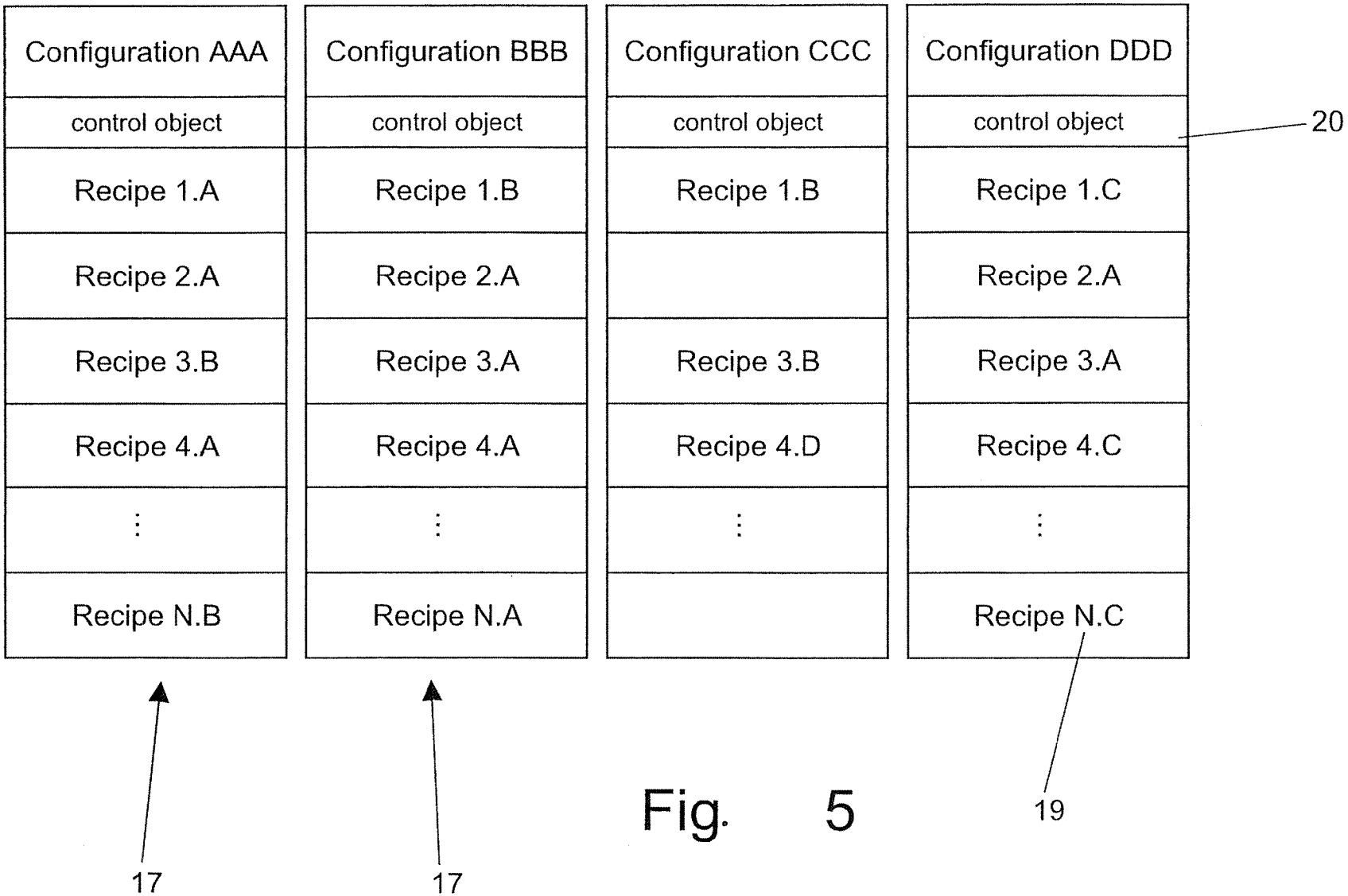

As shown in FIG. 5, each configuration 17 is defined by a combination of several compatible recipes 19, so each recipe 19 may potentially form part of a number of different configurations 17. In FIG. 5, for example, recipe 2.A forms part of three different configurations (AAA, BBB, DDD), and recipe 4.A of two different configurations (AAA, BBB), whereas recipe 4.E does not form part of any of the four configurations in FIG. 5.

Each recipe 19 is preferably identified by a respective identification tag (1.A, 1.B, 1.C . . . in FIG. 4), so each configuration 17 may be defined by a list of identification tags of the corresponding recipes 19. In other words, configuration AAA in FIG. 5 may be defined by simply assigning it the following list of identification tags: 1.A, 2.A, 3.B, 4.A . . . N.B.

In a preferred embodiment, each configuration 17 is assigned a control object 20 containing a list of the sections 18 in configuration 17. To complete each configuration 17, each section 18 in configuration 17 must be assigned a corresponding recipe 19 to ensure each configuration 17 contains all and only the corresponding sections 18. For example, a section 18 containing parameters 15 controlling application of a revenue strip is necessary to produce packets 2 of cigarettes fitted with revenue strips, but not for producing packets 2 of cigarettes with no revenue strips. Obviously, some sections 18 may be optional, whereas others, such as section 18 containing parameters 15 controlling supply of sheets 3 of wrapping, must always be present.

It is important to note that a configuration 17 may contain sections 18 that are not actually used in production and are disabled by a logic parameter in control object 20.

In a further embodiment shown in FIG. 2, each section 18 is assigned a congruence object 21, which indicates the other sections 18 that must form part of a configuration 17 comprising that particular section 18, and/or indicates the sections 18 that cannot form part of a configuration 17 comprising that particular section 18.

It should be noted that configurations 17 are normally composed dynamically: only a few configurations 17 are ready-made when installing automatic machine 1. Switching over to a new brand, i.e. creating a new configuration 17, often simply involves loading into the memory of control unit 9 the recipes 19 differing from the current configuration 17 of the previous brand. Saving the new configuration 17 therefore simply amounts to saving the modified recipes 19 and the new control object 20, which is identified by a new configuration 17 name, thus greatly speeding up the brand-change process.

Finally, to produce a new brand never produced before, a new configuration 17 can be created using a combination of existing recipes 19 not adopted before in an existing configuration 17. In which case, only the new control object 20 need be saved in the control unit 9 memory or in a bulk storage memory of interface device 10.

The brand control method described has numerous advantages, by being quick and easy to implement, and, above all, enabling highly efficient control of configurations 17. That is, as opposed to configurations 17 being totally unrelated and independent of one another, regardless of the similarity between them, each configuration 17 may share numerous components (i.e. recipes 19) with similar configurations 17. One configuration 17 may even differ from another by only one recipe 19. As such, updating one recipe 19 to improve the production process is automatically applied to all the configurations 17 containing that particular recipe 19. Consequently, the benefits of improving one recipe 19 are automatically also extended to all the configurations 17 containing that particular recipe 19, so configurations 17 all operate the same way, thus greatly simplifying maintenance, adjustments, and production process improvements.

Obviously, the brand control method described relative to a machine for cellophaning packets of cigarettes may be applied to advantage to any tobacco article processing machine, such as a cigarette maker, a filter maker, a cigarette filter assembly machine, a packing machine for producing packets of cigarettes, or a cartoning machine for producing cartons of packets of cigarettes.

The invention claimed is:

1. A brand control method for an automatic tobacco article processing machine (1); the automatic machine (1) producing an end product from materials supplied to the automatic machine (1), and comprising a number of electrically controlled operating parts (14) controlled by a control unit (9) using control parameters (15); the brand control method comprising the steps of:

defining a number of end product brands that can be produced on the automatic machine (1);

creating a number of configurations (17), each associated with a respective brand and comprising a set of values (16) of the control parameters (15) controlling the electrically controlled operating parts (14) to produce the brand;

selecting a desired end product brand; and loading the configuration (17) corresponding to the desired end product brand onto the control unit (9) to commence production of the desired brand;

the method being characterized by comprising the further steps of:

defining a number of sections (18), each comprising a set of control parameters (15) and independent of the other sections (18);

defining a number of recipes (19) by assigning each section (18) at least one respective set of values (16) of the corresponding control parameters (15), so each recipe (19) corresponds to a respective section (18) and contains the values (16) of the control parameters (15) in that particular section (18); and defining each configuration (17) by combining a number of compatible recipes (19), so that each recipe (19) may potentially form part of a number of different configurations (17).

2. A method as claimed in claim 1, wherein the control parameters (15) in the same section (18) are related to one another.

3. A method as claimed in claim 2, wherein the control parameters (15) in the same section (18) relate to operating parts (14) in the same section (18) of the automatic machine (1), or to operating parts (14) performing the same function.

4. A method as claimed in claim 1, and comprising the further steps of:

identifying each recipe (19) with a respective identification tag; and defining each configuration (17) by a list of identification tags of the corresponding recipes (19).

5. A method as claimed in claim 1, and comprising the further steps of:

assigning each configuration (17) a control object (20) containing a list of the sections (18) in the configuration (17); and making it compulsory, to complete each configuration (17), to assign each section (18) in the configuration (17) a corresponding recipe (19).

6. A method as claimed in claim 5, wherein a configuration (17) may comprise only some of the sections (18).

7. A method as claimed in claim 1, and comprising the further step of:

assigning each section (18) a congruence object (21), which indicates the other sections (18) that must form part of a configuration (17) comprising that particular section (18), and/or indicates the sections (18) that cannot form part of a configuration (17) comprising that particular section (18).

8. A method as claimed in claim 1, wherein the automatic machine (1) folds at least one sheet (3) of packing material about a group of tobacco articles.

9. A method as claimed in claim 8, wherein the automatic machine (1) is a packing machine for producing packets of cigarettes.

10. A method as claimed in claim 8, wherein the automatic machine (1) is a cellophaning machine for forming respective plastic wrappings about packets of cigarettes.

11. A method as claimed in claim 8, wherein the automatic machine (1) is a cartoning machine for producing cartons of packets of cigarettes.

12. A method as claimed in claim 1, wherein the automatic machine (1) is a cigarette maker.

13. A method as claimed in claim 1, wherein the automatic machine (1) is a filter assembly machine for applying filters to cigarettes.

* * * * *